US007030068B2

(12) United States Patent
Clare et al.

(10) Patent No.: US 7,030,068 B2
(45) **Date of Patent: *Apr. 18, 2006**

(54) AUTOMATIC DISHWASHING COMPOSITIONS COMPRISING BLOOMING PERFUME AND BASE MASKING INGREDIENTS

(75) Inventors: Jonathan Richard Clare, Newcastle Upon Tyne (GB); Carl-Eric Kaiser, Mason, OH (US); Virginia Pankratz, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/744,288

(22) Filed: Dec. 23, 2003

(65) Prior Publication Data

US 2004/0138078 A1 Jul. 15, 2004

Related U.S. Application Data

(63) Continuation of application No. 09/783,510, filed on Feb. 14, 2001, now abandoned.

(51) Int. Cl.
*C11D 3/50* (2006.01)

(52) U.S. Cl. ..... 510/101; 510/221

(58) Field of Classification Search ..... 510/101, 510/221

See application file for complete search history.

(56) References Cited

U.S. PATENT DOCUMENTS

| | | | |
|---|---|---|---|
| 3,860,525 | A | 1/1975 | Bechtold |
| 4,515,705 | A | 5/1985 | Moeddel |
| 5,089,162 | A | 2/1992 | Rapisarda et al. |
| 5,246,612 | A | 9/1993 | Van Dijk et al. |
| 6,143,707 | A | 11/2000 | Trinh et al. |
| 6,194,362 | B1 | 2/2001 | Trinh et al. |

FOREIGN PATENT DOCUMENTS

| | | |
|---|---|---|
| GB | 2311296 | 9/1997 |
| WO | WO 9734987 | 9/1997 |
| WO | WO 9900025 | 1/1999 |

OTHER PUBLICATIONS

U.S. Appl. No. 60/268486, Foley et al (Feb. 13, 2001).
U.S. Appl. No. 00/19078, Foley et al (Jul. 13, 2000).

*Primary Examiner*—John R. Hardee
(74) *Attorney, Agent, or Firm*—Steven W. Miller; Kim W. Zerby; Jeffrey V. Bamber

(57) ABSTRACT

Automatic dishwashing detergent compositions comprising bleaching agent or enzyme, and blooming perfume composition containing blooming perfume ingredients having a boiling point of less than about 260° C. and a ClogP of at least about 3, and wherein said perfume composition comprises at least 5 different blooming perfume ingredients, and base masking perfume ingredients having a boiling point of more than about 260° and a ClogP of at least about 3. Preferred compositions comprise amylase and/or protease enzymes.

19 Claims, No Drawings

AUTOMATIC DISHWASHING COMPOSITIONS COMPRISING BLOOMING PERFUME AND BASE MASKING INGREDIENTS

RELATED APPLICATION

The present application is a continuation of application Ser. No. 09/783,510, filed Feb. 14, 2001, now abandoned.

TECHNICAL FIELD

The present invention relates to automatic dishwashing detergent compositions comprising a bleaching agent or a detergent enzyme, or mixtures thereof. More specifically, the invention encompasses automatic dishwashing detergents comprising a blooming perfume composition containing blooming perfume ingredients and perfume ingredients that mask base odors from the bleaching agent and/or detergent enzyme. Preferred methods for washing tableware are included.

BACKGROUND OF THE INVENTION

Builders, surfactants, alkalinity, and bleaching chemicals traditionally have been used in automatic dishwashing detergent (ADD) compositions to promote soil removal from dishes, soil antiredeposition and anti-spotting benefits. However, strong alkalis like sodium hydroxide and bleaches such as hypochlorite can be damaging to, or leave a film upon, glasses, dishware or silverware. Accordingly, milder ADD compositions have been developed. These make use of a source of hydrogen peroxide, optionally with a bleach activator or catalyst. Further, enzymes such as commercial amylolytic enzymes (e.g., TERMAMYL® available from Novo Nordisk S/A) can be added to provide some benefit in the removal of starchy soils. ADDs containing amylases typically provide a somewhat more moderate wash pH in use and can remove starchy soils while avoiding delivering large weight equivalents of sodium hydroxide on a per-gram-of-product basis. Proteases are sometimes added to ADD compositions to improve cleaning performance on protein-based soils. However, bleaching agents, particularly hypochlorite bleaches, and enzymes have strong base odors that can be difficult to mask or cover up with perfume compositions. This is especially true in liquid, gel and paste compositions where the bleaching agents and enzymes can more readily degrade or react with other ingredients in the composition and introduce off odors.

BACKGROUND ART

U.S. Pat. No. 6,143,707, Trinh et al, issued Nov. 7, 2000, discloses automatic dishwashing detergent compositions comprising blooming perfume compositions containing blooming perfume ingredients, and optionally, delayed blooming perfume ingredients, and non-blooming perfume ingredients. The compositions can also contain bleaching agents and detergent enzymes.

U.S. Pat. No. 5,089,162, Rapisarda et al, issued Feb. 18, 1992, discloses cleaning compositions containing bleach-stable yellow colorant and either a chlorine bleach or an oxygen bleach. The compositions may be automatic dishwashing detergents, and preferably have a lemon-like scent. Various perfume ingredients and perfume compositions are disclosed.

SUMMARY OF THE INVENTION

It has now been discovered that automatic dishwashing detergent compositions comprising blooming perfume compositions, an effective amount of a bleaching agent or detergent enzyme, and builder can be formulated to provide cleaning and stain removal (e.g., tea stain removal) benefits, while also providing a positive scent signal to consumers during use.

Taken broadly, the present invention encompasses automatic dishwashing detergent compositions comprising, by weight:

(a) from about 0.01% to about 5% of a blooming perfume composition comprising from about 50% to about 99% of blooming perfume ingredients having a boiling point of less than about 260° C. and a ClogP of at least about 3, said perfume composition comprising at least 5 different blooming perfume ingredients, and from about 0.5% to about 10% of base masking perfume ingredients having a boiling point of more than about 260° C. and a ClogP of at least about 3;

(b) an effective amount of a bleaching agent or detergent enzyme;

(c) from about 10% to about 75% of a detergent builder; and (d) automatic dishwashing detergent adjunct material selected from the group consisting of detergent surfactant, bleach adjunct material, pH-adjusting material, chelating agent, dispersant polymer, material care agent, suds suppressor, and mixtures thereof.

The above compositions provide superior perfume effects in that they mask the base odors from the bleaching agent and/or detergent enzyme in the composition, while providing a pleasant fragrance in the area surrounding the automatic dishwashing machine during use. The ingredients of the perfume composition are also selected to minimize residual odor on washed tableware items.

The present invention also encompasses cleaning methods; more particularly, a method of washing tableware in a domestic automatic dishwashing appliance, comprising treating the soiled tableware in an automatic dishwasher with an aqueous bath comprising the composition as provided above.

All parts, percentages and ratios used herein are expressed as percent weight unless otherwise specified. All documents cited are, in relevant part, incorporated herein by reference.

DETAILED DESCRIPTION OF THE INVENTION

Automatic dishwashing compositions of the present invention comprise a blooming perfume composition, an effective amount of bleaching agent or detergent enzyme, or mixtures thereof, a detergent builder, and other detergent adjunct material, as described in more detail below.

Amounts of the essential ingredients can vary within wide ranges, however preferred automatic dishwashing detergent compositions herein (which have a 1% aqueous solution pH of from about 7 to about 12, more preferably from about 8 to about 11.5, especially from about 8.5 to about 11.3) are those comprising: from about 0.01% to about 5%, preferably from about 0.05% to about 3%, and more preferably from about 0.10% to about 2%, of a blooming perfume composition; from about 10% to about 75%, preferably from about 15% to about 50%, of detergent builder; an effective amount of bleaching agent or detergent enzyme; and detergent adjunct material. Preferred compositions further comprise from about 0.0001% to about 1%, preferably from about 0.001% to about 0.1%, of a bleach catalyst (most preferred cobalt catalysts, useful herein for hydrogen peroxide belaching agents, are present at from about 0.003% to about 0.01%); from about 0.1% to about 40%, preferably from about 0.1% to about 20%, of a water-soluble silicate; and from about 0.1% to about 20%, preferably from about 0.1% to about 10%, of a low-foaming nonionic surfactant. Fully-formulated embodiments typically further comprise from about 0.1% to about 15% of a polymeric dispersant, and from about 0.01% to about 10% of a chelant. Additional adjunct ingredients may be present. Detergent compositions herein in granular or tablet form typically limit water content, for example to less than about 7% free water, for best storage stability.

Preferred compositions herein are in the form of liquids, gels or pastes and contain from about 10% to about 90%, preferably from about 20% to about 80%, more preferably from about 40% to about 75%, of water. Because of the reactivity of bleaching agents and enzymes in such compositions, and the potential for generation of off odors, the benefits provided by the present blooming perfume composition containing base masking perfume ingredients are generally greater in such compositions.

By "effective amount" herein is meant an amount which is sufficient, under whatever comparative test conditions are employed, to enhance cleaning of a soiled surface. Likewise, the term "catalytically effective amount" refers to an amount of metal-containing bleach catalyst which is sufficient under whatever comparative test conditions are employed, to enhance cleaning of the soiled surface. In automatic dishwashing, the soiled surface may be, for example, a porcelain cup with tea stain or dishes soiled with simple starches or more complex food soils. The test conditions will vary, depending on the type of washing appliance used and the habits of the user. Of course, the performance of bleaches and enzymes will be affected by such considerations, and the levels used in fully-formulated detergent and cleaning compositions can be appropriately adjusted.

Blooming Perfume Composition

Blooming perfume compositions, as disclosed herein, can be formulated into automatic dishwashing detergent compositions and provide significantly better noticeability to the consumer than non-blooming perfume compositions not containing a substantial amount of blooming perfume ingredients. Additionally, residual perfume is not desirable on many surfaces, including dishes, glasses and cutlery, especially those made of plastic, rubber and silicone.

A blooming perfume ingredient is characterized by its boiling point (B.P.) and its octanol/water partition coefficient (P). The octanol/water partition coefficient of a perfume ingredient is the ratio between its equilibrium concentrations in octanol and in water. The preferred perfume ingredients of this invention have a B.P., determined at the normal, standard pressure of about 760 mm Hg, of about 260° C. or lower, preferably less than about 255° C.; and more preferably less than about 250° C., and an octanol/water partition coefficent P of about 1,000 or higher. Since the partition coefficients of the preferred perfume ingredients of this invention have high values, they are more conveniently given in the form of their logarithm to the base 10, logP. Thus the preferred perfume ingredients of this invention have logP at 25° C. of about 3 or higher.

Boiling points of many perfume compounds can be found in the following sources:

Properties of Organic Compounds Database CD-ROM Ver. 5.0 CRC Press Boca Raton, Fla.

Flavor and Fragrance—1995 Aldrich Chemical Co. Milwaukee, Wis.

STN database/on-line Design Institute of for Physical Property Data American Institute of Chemical Engineers STN database/on-line Beilstein Handbook of Organic Chemistry Beilstein Information Systems Perfume and Flavor Chemicals Steffen Arctander Vol. I, II—1969

When unreported, the 760 mm boiling points of perfume ingredients can be estimated. The following computer programs are useful for estimating these boilings points:

MPBPVP Version 1.25 © 1994–96 Meylan Syracuse Research Corporation (SRC) Syracuse, N.Y.

ZPARC ChemLogic, Inc. Cambridge, Mass.

The logP of many perfume ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the Pamona Med Chem/Daylight "CLOGP" program, Version 4.42 available from Biobyte Corporation, Claremont, Calif. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are preferably used instead of the experimental logP values in the selection of perfume ingredients which are useful in the present invention.

Thus, when a perfume composition which is composed of ingredients having a B.P. of about 260° C. or lower and a ClogP, or an experimental logP, of about 3 or higher, is used in an automatic dishwashing detergent composition, the perfume is very effusive and very noticeable when the product is used.

Table 1 gives some non-limiting examples of blooming perfume ingredients, useful in automatic dishwashing detergent compositions of the present invention. The blooming perfume compositions of the present invention contain at least 5 different blooming perfume ingredients, preferably at least 6 different blooming perfume ingredients, more preferably at least 7 different blooming perfume ingredients, and even more preferably at least 8 or 9 or even 10 or more different blooming perfume ingredients. Furthermore, the blooming perfume compositions of the present invention contain at least about 50 wt. % of blooming perfume ingredients, preferably at least about 55 wt. % of blooming perfume ingredients, more preferably at least about 60 wt. % of blooming perfume ingredients. The blooming perfume compositions herein preferably should not contain any single blooming ingredient at a level that would provide, by weight, more than about 2% of that ingredient to the total dishwashing composition, more preferably not more than about 1.5%, and even more preferably not more than about 0.5%, of the dishwashing composition.

The perfume composition itself preferably should not contain more than 60% of any single perfume ingredient.

Most common perfume ingredients which are derived from natural sources are composed of a multitude of components. For example, orange terpenes contain about 90% to about 95% d-limonene, but also contain many other minor ingredients. When each such material is used in the formulation of blooming perfume compositions of the present invention, it is counted as one ingredient, for the purpose of defining the invention. Synthetic reproductions of such natural perfume ingredients are also comprised of a multitude of components and are counted as one ingredient for the purpose of defining the invention.

The blooming perfume composition of the present invention can optionally contain "delayed blooming" perfume ingredients. The optional delayed blooming perfume ingredients of this invention have a B.P., measured at the normal, standard pressure, of about 260° C. or lower, preferably less than about 255° C.; and more preferably less than about 250° C., and a logP or ClogP of less than about 3. Thus, when a perfume composition is composed of some preferred blooming ingredients and some delayed blooming ingredients, the perfume effect is longer lasting when the product is used. Table 2 gives some non-limiting examples of optional delayed blooming perfume ingredients useful in automatic dishwashing detergent compositions of the present invention. Delayed blooming perfume ingredients are used primarily in applications where the water will evaporate, thus liberating the perfume.

When delayed blooming perfume ingredients are used in combination with the blooming perfume ingredients in the blooming perfume compositions of the present invention, the weight ratio of blooming perfume ingredients to delayed blooming perfume ingredients is typically at least about 1.1, preferably at least about 1.5, more preferably at least about 2. The blooming perfume compositions preferably contain at least about 55 wt. % of the combined blooming perfume ingredients and delayed blooming perfume ingredients, preferably at least about 60 wt. % of the combined perfume ingredients, more preferably at least about 70 wt. % of the combined perfume ingredients, and even more preferably at least about 80 wt. % of the combined perfume ingredients. When some optional delayed blooming perfume ingredients are used in combination with the blooming perfume ingredients in the blooming perfume compositions, the blooming perfume compositions of the present invention contain at least 5 different blooming perfume ingredients and 2 different delayed blooming perfume ingredients, preferably at least 6 different blooming perfume ingredients and 3 different delayed blooming perfume ingredients, and more preferably at least 7 or more different blooming perfume ingredients.

In the perfume art, some auxiliary materials having no odor, or a low odor, are used, e.g., as solvents, diluents, extenders or fixatives. Non-limiting examples of these materials are ethyl alcohol, carbitol, dipropylene glycol, diethyl phthalate, triethyl citrate, isopropyl myristate, and benzyl benzoate. These materials are used for, e.g., solubilizing or diluting some solid or viscous perfume ingredients to, e.g., improve handling and/or formulating. These materials are useful in the blooming perfume compositions, but are not counted in the calculation of the limits for the definition/formulation of the blooming perfume compositions of the present invention.

Non-blooming perfume ingredients are those having a B.P. of more than about 260° C. Table 3 gives some non-limiting examples of non-blooming perfume ingredients that have a ClogP of less than about 3. In certain automatic dishwashing detergent compositions, some non-blooming perfume ingredients can be used in small amounts, e.g., to improve overall perfume odor.

The blooming perfume compositions of present invention also comprise from about 0.5% to about 10%, preferably from about 1% to about 9%, more preferably from about 1.5% to about 8%, and most preferably from about 2% to about 7%, of non-blooming perfume ingredients having a B.P. of more than about 260° C. and having a ClogP of at least about 3. These ingredients are particularly effective at masking base odors from bleaching agents and/or detergent enzymes. When used at the low levels herein, an improved blooming perfume composition is obtained that betters masks base odors while still minimizing residual perfume on dishes and tableware. Table 4 provides some non-limiting examples of such base masking perfume ingredients.

In the following tables, measured boiling points are taken from the above-mentioned sources.

Estimated boilings points are an average of those determined by the above-mentioned computer programs.

The predicted ClogP at 25° C. was determined by the following computer program:

Panoma MedChem/Daylight ClogP V. 4.42

TABLE 1

Examples of Blooming Perfume Ingredients

| Ingredient | ClogP (Pred.) | Boiling Pt. (Meas.) | Boiling Pt. (Pred.) |
|---|---|---|---|
| Allo-ocimene | 4.36 | | 195 |
| Allyl cyclohexanepropionate | 3.94 | | 252 |
| Allyl heptanoate | 3.40 | | 209 |
| trans-Anethole | 3.31 | 232 | |
| Benzyl butyrate | 3.02 | 240 | |
| Camphene | 4.18 | 160 | |
| Cadinene | 7.27 | | 252 |
| Carvacrol | 3.40 | 238 | |
| cis-3-Hexenyl tiglate | 3.80 | | 225 |
| Citronellol | 3.25 | 223 | |
| Citronellyl acetate | 4.20 | 234 | |
| Citronellyl nitrile | 3.09 | 226 | |
| Citronellyl propionate | 4.73 | | 257 |
| Cyclohexylethyl acetate | 3.36 | 222 | |
| Decyl Aldehyde (Capraldehyde) | 4.01 | 208 | |
| Delta Damascone | 3.62 | | 256 |
| Dihydromyrcenol | 3.03 | 192 | |
| Dihydromyrcenyl acetate | 3.98 | | 221 |
| 3,7-Dimethyl-1-octanol | 3.74 | 205 | |
| Diphenyloxide | 4.24 | 259 | |
| Fenchyl Acetate (1,3,3-Trimethyl-2-norbornanyl acetate) | 3.53 | | 234 |
| Geranyl acetate | 3.72 | 233 | |
| Geranyl formate | 3.27 | | 231 |
| Geranyl nitrile | 3.25 | 228 | |
| cis-3-Hexenyl isobutyrate | 3.27 | | 204 |
| Hexyl Neopentanoate | 4.06 | | 213 |
| Hexyl tiglate | 4.28 | | 221 |
| alpha-Ionone | 3.71 | 237 | |
| Isobornyl acetate | 3.53 | 238 | |
| Isobutyl benzoate | 3.57 | 242 | |
| Isononyl acetate | 4.28 | | 220 |
| Isononyl alcohol (3,5,5-Trimethyl-1-hexanol) | 3.08 | 194 | |
| Isopulegyl acetate | 3.70 | | 243 |
| Lauraldehyde | 5.07 | 250 | |
| Linalyl acetate | 3.50 | | 230 |
| Lorysia | 4.06 | | 236 |
| D-limonene | 4.35 | | 177 |
| Lymolene | 3.03 | | 198 |
| (−)-L-Menthyl acetate | 4.18 | 227 | |
| Methyl Chavicol (Estragole) | 3.13 | 216 | |
| Methyl n-nonyl acetaldehyde | 4.85 | 247 | |
| Methyl octyl acetaldehyde | 4.32 | | 224 |
| beta--Myrcene | 4.33 | | 165 |
| Neryl acetate | 3.72 | 236 | |
| Nonyl acetate | 4.41 | 229 | |
| Nonaldehyde | 3.48 | 191 | |
| Para-Cymene | 4.07 | 173 | |

TABLE 1-continued

Examples of Blooming Perfume Ingredients

| Ingredient | ClogP (Pred.) | Boiling Pt. (Meas.) | Boiling Pt. (Pred.) |
|---|---|---|---|
| alpha-Pinene | 4.18 | 156 | |
| beta--Pinene | 4.18 | 166 | |
| alpha-Terpinene | 4.41 | 175 | |
| gamma-Terpinene | 4.35 | 183 | |
| Terpineolene | 4.35 | | 172 |
| alpha-Terpinyl acetate | 3.58 | 220 | |
| Tetrahydrolinalool | 3.52 | 202 | |
| Tetrahydromyrcenol | 3.52 | 195 | |
| 2-Undecenal | 4.22 | | 235 |
| Verdox (o-t-Butylcyclohexyl acetate) | 4.06 | | 239 |
| Vertenex (4-tert.Butylcyclohexyl acetate) | 4.06 | | 237 |

TABLE 2

Examples of "Delayed Blooming" Perfume Ingredients

| Ingredient | ClogP (Pred.) | Boiling Pt. (Meas.) | Boiling Pt. (Pred.) |
|---|---|---|---|
| Allyl Amyl Glycolate | 2.38 | | 218 |
| Allyl caproate | 2.87 | 186 | |
| Amyl acetate (n-Pentyl acetate) | 2.30 | 147 | |
| Amyl Propionate | 2.83 | 169 | |
| p-Anisaldehyde | 1.78 | 249 | |
| Anisic Aldehyde | 1.78 | | 220 |
| Anisole | 2.06 | 154 | |
| Benzaldehyde (Benzenecarboxaldehyde) | 1.50 | 179 | |
| Benzyl acetate | 1.96 | 211 | |
| Benzylacetone | 1.74 | 234 | |
| Benzyl alcohol | 1.10 | 205 | |
| Benzyl formate | 1.50 | 203 | |
| Benzyl propionate | 2.49 | 221 | |
| beta-gamma-Hexenol (2-Hexen-1-ol) | 1.40 | | 164 |
| (+)-Camphor | 2.18 | 207 | |
| (+)-Carvone | 2.01 | 231 | |
| L-Carvone | 2.01 | | 230 |
| Cinnamic alcohol | 1.41 | | 258 |
| Cinnamyl formate | 1.91 | 252 | |
| cis-Jasmone | 2.64 | | 253 |
| cis-3-Hexenyl acetate | 2.34 | | 175 |
| Citral (Neral) | 2.95 | 208 | |
| Cumic alcohol | 2.53 | 249 | |
| Cuminaldehyde | 2.92 | 235 | |
| Cyclal (2,4-Dimethyl-3-cyclohexene-1-carboxaldehyde) | 2.36 | | 203 |
| Dimethyl benzyl carbinol | 1.89 | 215 | |
| Dimethyl benzyl carbinyl acetate | 2.84 | | 248 |
| Ethyl acetate | 0.71 | 77 | |
| Ethyl acetoacetate | 0.33 | 181 | |
| Ethyl amyl ketone | 2.44 | 167 | |
| Ethyl benzoate | 2.64 | 215 | |
| Ethyl butanoate | 1.77 | 121 | |
| Ethyl Butyrate | 1.77 | | 124 |
| Ethyl-2-methyl butryrate | 2.08 | | 131 |
| Ethyl-2-methyl pentanoate | 2.69 | | 159 |
| 3-Nonanone (Ethyl hexyl ketone) | 2.97 | 187 | |
| Ethyl phenylacetate | 2.35 | 228 | |
| Eucalyptol | 2.76 | 176 | |
| Eugenol | 2.40 | 253 | |
| Fenchyl alcohol | 2.58 | 199 | |
| Flor Acetate (Tricyclodecenyl acetate) | 2.36 | | 233 |
| Frutene (Tricyclodecenyl propionate) | 2.89 | | 250 |
| gamma-Nonalactone | 2.77 | 243 | |
| trans-Geraniol | 2.77 | 230 | |
| cis-3-Hexen-1-ol/Leaf Alcohol | 1.40 | 156 | |
| Hexyl acetate | 2.83 | 171 | |
| Hexyl formate | 2.38 | 155 | |
| Hydratopic alcohol | 1.58 | | 233 |
| Hydroxycitronellal | 1.54 | 241 | |
| Indole (2,3-Benzopyrrole) | 2.13 | 254 | |

TABLE 2-continued

Examples of "Delayed Blooming" Perfume Ingredients

| Ingredient | ClogP (Pred.) | Boiling Pt. (Meas.) | Boiling Pt. (Pred.) |
|---|---|---|---|
| Isoamyl alcohol | 1.22 | 131 | |
| Isopropyl phenylacetate | 2.66 | | 237 |
| Isopulegol | 2.75 | | 231 |
| Isoquinoline (Benzopyridine) | 1.82 | 243 | |
| Ligustral (2,4-Dimethyl-3-Cyclohexene-1-carboxaldehyde) | 2.36 | | 204 |
| Linalool | 2.55 | 193 | |
| Linalool oxide | 1.45 | | 223 |
| Menthone | 2.83 | | 214 |
| 4-Methylacetophenone | 2.08 | 226 | |
| Methyl pentyl ketone | 1.91 | 151 | |
| Methyl anthranilate | 2.02 | 256 | |
| Methyl benzoate | 2.11 | 199 | |
| Methyl Phenyl Carbinyl Acetate (alpha-Methylbenzyl acetate) | 2.27 | | 216 |
| Methyl Eugenol (Eugenyl methyl ether) | 2.67 | 254 | |
| Methyl Heptenone (6-Methyl-5-hepten-2-one) | 1.82 | 173 | |
| Methyl Heptine Carbonate (Methyl 2-octynoate) | 2.57 | 218 | |
| Methyl Heptyl ketone | 2.97 | 195 | |
| Methyl Hexyl ketone | 2.44 | 173 | |
| Methyl pamplemousse (1,1-dimethoxy-2,2,5-trimethyl-4-hexene) | 2.70 | | 194 |
| Methyl salicylate | 2.45 | 223 | |
| Dimethyl anthranilate | 2.16 | 255 | |
| Nerol | 2.77 | 225 | |
| delta-Nonalactone | 2.80 | | 226 |
| gamma-Octalactone | 2.24 | 256 | |
| 2-Octanol | 2.72 | 180 | |
| Octyl Aldehyde (Caprylic aldehyde) | 2.95 | 167 | |
| p-Cresol | 1.97 | 202 | |
| p-Cresyl methyl ether | 2.56 | 175 | |
| Acetanisole | 1.80 | 258 | |
| 2-Phenoxyethanol | 1.19 | 245 | |
| Phenylacetaldehyde | 1.78 | 195 | |
| 2-Phenylethyl acetate | 2.13 | 235 | |
| Phenethyl alcohol | 1.18 | 218 | |
| Phenyl Ethyl dimethyl Carbinol (Benzyl-tert-butanol) | 2.42 | | 257 |
| Prenyl acetate | 1.68 | | 150 |
| Propyl butanoate | 2.30 | 143 | |
| (+)-Pulegone | 2.50 | 224 | |
| Rose oxide | 2.90 | | 197 |
| Safrole | 2.57 | 235 | |
| 4-Terpinenol | 2.75 | 211 | |
| Alpha Terpineol | 2.75 | | 222 |
| Triplal (2,4-Dimethyl-3-Cyclohexene-1-carboxaldehyde) | 2.36 | | 204 |
| Veratrole (1,2-Dimethoxybenzene) | 1.60 | 206 | |
| Violiff | 2.77 | | 238 |
| Viridine (Phenylacetaldehyde dimethyl acetal) | 1.29 | 220 | |

TABLE 3

Examples of "Non-Blooming" Perfume Ingredients Having ClogP of Less Than About 3

| Ingredient | ClogP (Pred.) | Boiling Pt. (Meas.) | Boiling Pt. (Pred.) |
|---|---|---|---|
| Coumarin | 1.41 | 302 | |
| Ethyl methylphenylglycidate | 2.71 | 274 | |
| Ethyl Vanillin | 1.80 | 285 | |
| Isoeugenol | 2.58 | 266 | |
| Methyl cinnamate | 2.47 | 262 | |
| Methyl dihydro jasmonate | 2.42 | | 314 |
| Methyl beta-naphthyl ketone | 2.76 | 302 | |
| Phenoxy ethyl isobutyrate | 2.92 | | 277 |
| Vanillin | 1.28 | 285 | |

TABLE 4

Examples of "Base Masking" Perfume Ingredients

| Ingredient | ClogP (Pred.) | Boiling Pt. (Meas.) | Boiling Pt. (Pred.) |
|---|---|---|---|
| (Ambrettolide) Oxacycloheptadec-10-en-2-one | 6.36 | | 352 |
| (Amyl benzoate) n-Pentyl benzoate | 4.23 | | 263 |
| Isoamyl cinnamate | 4.45 | | 300 |
| alpha-Amylcinnamaldehyde | 4.32 | 289 | |
| alpha-Amylcinnamaldehyde dimethyl acetal | 4.03 | | 320 |
| (iso-Amyl Salicylate) isopentyl salicylate | 4.43 | 277 | |
| (Aurantiol) Methyl anthranilate/hydroxycitronellal Schiff base | 4.22 | | 413 |
| Benzophenone | 3.18 | 305 | |
| Benzyl salicylate | 4.21 | 320 | |
| beta-Caryophyllene | 6.45 | | 263 |
| Cedrol | 4.53 | | 274 |
| Cedryl acetate | 5.48 | | 289 |
| Cinnamyl cinnamate | 4.64 | | 387 |
| Citrathal | 3.93 | | 262 |
| Citronellyl isobutyrate | 5.04 | | 266 |
| Clonal | 4.90 | | 267 |
| Cyclohexyl salicylate | 4.48 | | 327 |
| Cyclamen aldehyde | 3.46 | | 271 |
| Cyclabute | 3.41 | | 275 |
| delta-Dodecalactone | 4.39 | | 279 |
| (Dihydro Isojasmonate) Methyl 2-hexyl-3-oxo-cyclopentanecarboxylate | 3.09 | | 314 |
| Diphenylmethane | 4.06 | 265 | |
| Ethylene brassylate | 4.62 | | 390 |
| Ethyl undecylenate | 4.99 | 261 | |
| Florhydral | 3.55 | | 277 |
| Iso E Super | 4.85 | | 306 |
| (Exaltolide) Pentadecanolide | 6.29 | | 338 |
| (Galaxolide) 4,6,6,7,8,8-Hexamethyl-1,3,4,6,7,8-hexahydro-cyclopenta(G)-2-benzopyran | 6.06 | | 335 |
| gamma-Methyl Ionone (alpha-Isomethylionone) | 4.02 | | 278 |
| Geranyl isobutyrate | 5.00 | | 295 |
| Habanolide | 6.29 | | 330 |
| Hexadecanolide | 6.85 | | 352 |
| cis-3-Hexenyl salicylate | 4.61 | | 323 |
| alpha-Hexylcinnamaldehyde | 4.85 | | 334 |
| n-Hexyl salicylate | 5.09 | | 318 |
| Hexadecanolide | 6.85 | | 352 |
| Ionone Beta | 3.77 | | 276 |
| alpha---Irone | 4.23 | | 279 |
| 6-Isobutylquinoline | 3.99 | | 294 |
| Lilial (p-tert.Butyl-alpha-methyldihydrocinnamic aldehyde, PT Bucinol) | 3.86 | | 282 |
| Linalyl benzoate | 5.42 | | 325 |
| (2-Methoxy Naphthalene) beta-Naphthyl methyl ether | 3.24 | 274 | |
| Nectaryl | 4.43 | | 317 |
| Neobutenone | 3.63 | | 266 |
| 10-Oxahexadecanolide | 4.38 | | 355 |
| Patchouli alcohol | 4.53 | | 317 |
| (Phantolide) 5-Acetyl-1,1,2,3,3,6-hexamethylindan | 5.69 | | 333 |
| Phenethyl benzoate | 4.06 | | 335 |
| Phenethyl phenylacetate | 3.77 | | 350 |
| Phenyl Hexanol (3-Methyl-5-phenyl-1-pentanol) | 3.17 | | 296 |
| Tonalid (7-Acetyl-1,1,3,4,4,6-hexamethyltetralin) | 6.25 | | 344 |
| delta-Undecalactone | 3.86 | | 262 |
| gamma-Undecalactone | 3.83 | 286 | |
| Vertinert Acetate | 5.47 | | 332 |

Perfumes suitable for use in automatic dishwashing detergent compositions can be formulated from known fragrance ingredients, and for purposes of enhancing environmental compatibility, the perfume is preferably substantially free of halogenated fragrance materials and nitromusks.

The compositions of this invention may contain an effective amount of various moisture-activated encapsulated perfume particles, as an optional ingredient. These are described in detail in U.S. Pat. No. 6,143,707, Trinh et al., incorporated herein by reference. The encapsulated particles act as protective carriers and reduce the loss of perfume prior to use. Such materials include, for example, cyclodextrin/perfume inclusion complexes, polysaccharide cellular matrix perfume microcapsules, and the like. Encapsulation of perfume minimizes the diffusion and loss of the volatile blooming perfume ingredients. Perfume is released when the materials are wetted, to provide a pleasant odor signal in use. Especially preferred are cyclodextrin inclusion complexes.

The optional water-activated protective perfume carriers allow the use of lower levels of perfume in the detergent compositions herein because of the reduced loss of the perfume during manufacturing and use. Due to the minimal loss of the volatile ingredients in the blooming perfume compositions, perfume compositions that incorporate water activated protective perfume carrier can contain less blooming perfume ingredients than those used in the free, unencapsulated form. The encapsulated and/or complexed perfume compositions typically contain at least about 20%, preferably at least about 30%, and more preferably at least about 40%, blooming perfume ingredients. Optionally, but preferably, compositions that contain encapsulated and/or complexed perfume also comprise free perfume in order to provide consumers with a positive scent signal before the composition is used.

Bleaching Agent

Bleaching agents useful in the present invention include both chlorine based and hydrogen peroxide based bleaching ingredients.

Automatic dishwashing detergent compositions containing chlorine bleach are described in detail in U.S. Pat. No. 4,714,562, Roselle, et al., issued Dec. 22, 1987, and U.S. Pat. No. 4,917,812, Cilley, issued Apr. 17, 1990, which are incorporated herein by reference.

The compositions of the invention can contain an amount of a chlorine bleach ingredient sufficient to provide the composition with preferably from about 0.1% to about 5.0%, most preferably from about 0.5% to about 3.0%, of available chlorine based on the weight of the detergent composition.

Methods for determining "available chlorine" of compositions incorporating chlorine bleach materials are well known in the art. Available chlorine is the chlorine which can be liberated by acidification of an aqueous solution of hypochlorite ions (or a material that can form hypochlorite ions in aqueous solution) and at least a molar equivalent amount of chloride ions. Numerous materials are known which provide available chlorine.

Many chlorine bleach materials are known, such as disclosed in Mizuno, W. G., "Dishwashing", *Detergency: Theory and Test Methods*, Surfactant Science Series, Volume 5, Part III, pages 872–878. Chlorine bleach materials useful in the subject invention compositions include alkali metal hypochlorites, hypochlorite addition products, and N-chloro compounds usually containing an organic radical. N-chloro compounds are usually characterized by a double bond on the atom adjacent to a trivalent nitrogen and a chlorine ($Cl^+$) attached to the nitrogen which is readily exchanges with $H^+$ or $M^+$ (where $M^+$ is a common metal ion such as $Na^+$, $K^+$, etc.), so as to release HOCl or $OCl^-$ on hydrolysis.

Preferred alkali metal hypochorite compounds useful in the detergent compositions herein include sodium hypochlorite, potassium hypochlorite, and lithium hypochlorite. Although known as chlorine bleach materials, alkaline earth metal hypochlorites, such as calcium hypochlorite and magnesium hypochlorite, are not preferred for the present compositions due to poor compatibility of the alkaline earth metal cations with anionic surfactants.

A preferred hypochlorite addition product useful in the detergent compositions of this invention is chlorinated trisodium phosphate, which is a crystalline hydrated double salt of trisodium phosphate and sodium hypochlorite, prepared by crystallizing from an aqueous blend of sodium hypochlorite, castic soda, trisodium phosphate, and disodium phosphate. Chlorinated trisodium phosphate is typically commercially available as chlorinated trisodium phosphate dodecahydrate.

Examples of N-chloro compounds useful as chlorine bleach materials in the subject compositions include trichlorolisocyanuric acid, dichloroisocynauric acid, monochloroisocyanuric acid, 1,3-dichloro-5,5-dimethylhydantoin, 1-chloro-5,5-dimethylhydantoin, N-chlorosuccinimide, N-chlorosulfamate, N-chloro-p-nitroacetanilide, N-chloro-o-nitroacetanilide, N-chloro-m-nitroacetanilide, N-m-dichloroacetanilide, N-p-dichloroacetanilide, Dichloramine-T, N-chloro-propionanilide, N-chlorobutyranilide, N-chloroacetanilide, N-o-dichloroacetanilide, N-chloro-p-acetotoluide, N-chloro-m-acetotoluide, N-chloroformanilide, N-chloro-o-acetotoluide, Chloramine-T, ammonia monochloramine, albuminoid chloramines, N-chlorosulfamide, Chloramine B, Dichloramine B, Di-Halo (bromochlorodimethylhydantoin), N,N'-dichlorobenzoylene urea, p-toluene sulfodichloroamide, trichloromelamine, N-chloroammeline, N,N'-dichloroazodicarbonamide, N-chloroacetyl urea, N,N'-dichlorobiuret, chlorinated dicyandiamide, and alkali metal salts of the above acids, and stable hydrates of the above compounds.

Particularly preferred chlorine bleach materials useful in the detergent compositions herein are chloroisocynanuric acids and alkali metal salts thereof, preferably potassium, and especially sodium salts thereof. Examples of such compounds include trichloroisocyananuric acid, dichloroisocyanuric acid, sodium dichloroisocyanurate, potassium dichloroisocyanurate, and trichloro-potassium dichloroisocynanurate complex. The most preferred chlorine bleach material is sodium dichloroisocyanurate. The dihydrate of this material is particularly preferred due to its excellent stability.

Hydrogen peroxide sources are described in detail in Kirk Othmer's Encyclopedia of Chemical Technology, 4th Ed (1992, John Wiley & Sons), Vol. 4, pp. 271–300 "Bleaching Agents (Survey)". These include the various forms of sodium perborate and sodium percarbonate, including various coated and modified forms. An "effective amount" of a source of hydrogen peroxide is any amount capable of measurably improving stain removal (especially of tea stains) from soiled dishware compared to a hydrogen peroxide source-free composition when the soiled dishware is washed by the consumer in a domestic automatic dishwasher in the presence of alkali.

More generally, a source of hydrogen peroxide herein is any convenient compound or mixture which under consumer use conditions provides an effective amount of hydrogen peroxide. Levels may vary widely and are usually in the range from about 0.1% to about 70%, more typically from about 0.5% to about 30%, by weight of the ADD compositions herein.

The source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

While effective bleaching compositions herein may comprise cobalt catalysts and a source of hydrogen peroxide, fully-formulated ADD compositions typically will also comprise other automatic dishwashing detergent adjunct materials to improve or modify performance. These materials are selected as appropriate for the properties required of an automatic dishwashing composition. For example, low spotting and filming is desired—preferred compositions have spotting and filming grades of 3 or less, preferably less than 2, and most preferably less than 1, as measured by the standard test of The American Society for Testing and Materials ("ASTM") D3556-85 (Reapproved 1989) "Standard Test Method for Deposition on Glassware During Mechanical Dishwashing". Also for example, low sudsing is desired—preferred compositions produce less than 2 inches, more preferably less than 1 inch, of suds in the bottom of the dishwashing machine during normal use conditions (as determined using known methods such as, for example, that described in U.S. Pat. No. 5,294,365, to Welch et al., issued Mar. 15, 1994).

Detergent Enzymes

"Detergent enzyme", as used herein, means any enzyme having a cleaning, stain removing or otherwise beneficial effect in an ADD composition. Preferred enzymes are hydrolases such as proteases, amylases and lipases. Highly preferred for automatic dishwashing are amylases and/or proteases, including both current commercially available types and improved types which, though more bleach compatible, have a remaining degree of bleach deactivation susceptibility.

The ADD compositions herein comprise one or more enzymes. If only one enzyme is used, it is preferably an amyolytic enzyme. Highly preferred for automatic dishwashing is a mixture of proteolytic enzymes and amyloytic enzymes. More generally, the enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders, etc. In this respect bacterial or fungal enzymes are preferred, such as bacterial amylases and proteases, and fungal cellulases.

Enzymes are normally incorporated in the instant detergent compositions at levels sufficient to provide a "cleaning-effective amount". The term "cleaning-effective amount" refers to any amount capable of producing a cleaning, stain removal or soil removal effect on substrates such as fabrics, dishware and the like. Since enzymes are catalytic materials, such amounts may be very small. In practical terms for current commercial preparations, typical amounts are up to about 5 mg by weight, more typically about 0.01 mg to about 3 mg, of active enzyme per gram of the composition. Stated otherwise, the compositions herein will typically comprise from about 0.001% to about 6%, preferably 0.01%–1% by weight of a commercial enzyme preparation. Protease enzymes are usually present in such commercial preparations at levels sufficient to provide from 0.005 to 0.1 Anson units (AU) of activity per gram of composition. For automatic dishwashing purposes, it may be desirable to increase the active enzyme content of the commercial preparations, in order to minimize the total amount of non-catalytically active materials delivered and thereby improve spotting/filming results.

Suitable examples of proteases are the subtilisins which are obtained from particular strains of *B. subtilis* and *B. licheniformis*. Another suitable protease is obtained from a strain of *Bacillus,* having maximum activity throughout the pH range of 8–12, developed and sold by Novo Industries A/S as ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE® and SAVINASE® by Novo Industries A/S (Denmark). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

An especially preferred protease, referred to as "Protease D", as described in U.S. Pat. No. 5,679,630, Baeck, et al, and U.S. Pat. No. 5,677,272, Ghosh, et al, both incorporated herein by reference.

Amylases suitable herein include, for example, α-amylases described in British Patent Specification No. 1,296,839 (Novo).

Engineering of enzymes (e.g., stability-enhanced amylase) for improved stability, e.g., oxidative stability is known. See, for example, J. Biological Chem., Vol. 260, No. 11, June 1985, pp 6518–6521. "Reference amylase" refers to a conventional amylase inside the scope of the amylase component of this invention. Further, stability-enhanced amylases, also within the invention, are typically compared to these "reference amylases".

The present invention, in certain preferred embodiments, can makes use of amylases having improved stability in detergents, especially improved oxidative stability. A convenient absolute stability reference-point against which amylases used in these preferred embodiments of the instant invention represent a measurable improvement is the stability of TERMAMYL® in commercial use in 1993 and available from Novo Nordisk A/S. This TERMAMYL® amylase is a "reference amylase", and is itself well-suited for use in the ADD (Automatic Dishwashing Detergent) compositions of the invention. Even more preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, all measured versus the above-identified reference-amylase. Preferred amylases herein can demonstrate further improvement versus more challenging reference amylases, the latter reference amylases being illustrated by any of the precursor amylases of which preferred amylases within the invention are variants. Such precursor amylases may themselves be natural or be the product of genetic engineering. Stability can be measured using any of the art-disclosed technical tests. See references disclosed in WO 94/02597, itself and documents therein referred to being incorporated by reference.

In general, stability-enhanced amylases respecting the preferred embodiments of the invention can be obtained from Novo Nordisk A/S, or from Genencor International.

Preferred amylases herein have the commonality of being derived using site-directed mutagenesis from one or more of the *Baccillus* amylases, especialy the *Bacillus* alpha-amylases, regardless of whether one, two or multiple amylase strains are the immediate precursors.

Such amylases are non-limitingly illustrated by the following:

(i) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B. licheniformis* alpha-amylase, known as TERMAMYL®, or the homologous position variation of a similar parent amylase, such as *B. amyloliquefaciens, B. subtilis*, or *B. stearothermophilus;*

(ii) Stability-enhanced amylases as described by Genencor International in a paper entitled "Oxidatively Resistant alpha-Amylases" presented at the 207th American Chemical Society National Meeting, Mar. 13–17, 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8,15, 197,256,304,366 and 438 leading to specific mutants, particularly important being M197L and M197T with the M197T variant being the most stable expressed variant. Stability was measured in CASCADE® and SUNLIGHT®;

(iii) Particularly preferred herein are amylase variants having additional modification in the immediate parent available from Novo Nordisk A/S. These amylases do not yet have a tradename but are those referred to by the supplier as QL37+M197T.

Any other oxidative stability-enhanced amylase can be used, for example as derived by site-directed mutagenesis from known chimeric, hybrid or simple mutant parent forms of available amylases.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, and in the above incorporated U.S. Pat. No. 6,143,707, Trinh et al, issued Nov. 7, 2000. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Builders

Detergent builders are included in the compositions herein to assist in controlling mineral hardness. Inorganic as well as organic builders can be used. Builders are typically used in automatic dishwashing and fabric laundering compositions, for example to assist in the removal of particulate soils.

Inorganic or non-phosphate P-containing detergent builders include, but are not limited to, phosphonates, phytic acid, silicates, carbonates (including bicarbonates and sesquicarbonates), sulfates, citrate, zeolite or layered silicate, and aluminosilicates. See U.S. Pat. No. 4,605,509 for examples of preferred aluminosilicates.

Examples of carbonate builders are the alkaline earth and alkali metal carbonates as disclosed in German Patent Application No. 2,321,001 published on Nov. 15, 1973. Various grades and types of sodium carbonate and sodium sesquicarbonate may be used, certain of which are particularly useful as carriers for other ingredients, especially detersive surfactants.

Aluminosilicate builders may be used in the present compositions though are not preferred for automatic dishwashing detergents. Aluminosilicate builders are of great importance in most currently marketed heavy duty granular detergent compositions, and can also be a significant builder ingredient in liquid detergent formulations. Aluminosilicate builders include those having the empirical formula: $Na_2O.Al_2O_3.xSiO_z.yH_2O$ wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In another embodiment, the crystalline aluminosilicate ion exchange material has the formula: $Na_{12}[(AlO_2)_{12}(SiO_2)_{12}].xH_2O$ wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter. Individual particles can desirably be even smaller than 0.1 micron to further assist kinetics of exchange through maximization of surface area. High surface area also increases utility of aluminosilicates as adsorbents for surfactants, especially in granular compositions. Aggregates of silicate or aluminosilicate particles may be useful, a single aggregate having dimensions tailored to minimize segregation in granular compositions, while the aggregate particle remains dispersible to submicron individual particles during the wash. As with other builders such as carbonates, it may be desirable to use zeolites in any physical or morphological form adapted to promote surfactant carrier function, and appropriate particle sizes may be freely selected by the formulator.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt or "overbased". When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediaminetetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty laundry detergent and automatic dishwashing formulations due to their availability from renewable resources and their biodegradability. Citrates can also be used in combination with zeolite, the aforementioned BRITESIL types, and/or layered silicate builders. Oxydisuccinates are also useful in such compositions and combinations.

Also suitable in the detergent compositions of the present invention are the 3,3-dicarboxy-4-oxa-1,6-hexanedionates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also U.S. Pat. No. 3,723,322.

Where phosphorus-based builders can be used, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used though such materials are more commonly used in a low-level mode as chelants or stabilizers.

Phosphate detergent builders for use in ADD compositions are well known. They include, but are not limited to, the alkali metal, ammonium and alkanolammonium salts of polyphosphates (exemplified by the tripolyphosphates, pyrophosphates, and glassy polymeric meta-phosphates). Phosphate builder sources are described in detail in Kirk Othmer, 3rd Edition, Vol. 17, pp. 426–472 and in "Advanced Inorganic Chemistry" by Cotton and Wilkinson, pp. 394–400 (John Wiley and Sons, Inc.; 1972).

Adjunct Materials

Detersive ingredients or adjuncts optionally included in the instant compositions can include one or more materials for assisting or enhancing cleaning performance, treatment of the substrate to be cleaned, or designed to improve the aesthetics of the compositions. They are further selected based on the form of the composition, i.e., whether the composition is to be sold as a liquid, paste (semi-solid), or solid form (including tablets and the preferred granular forms for the present compositions). Adjuncts which can also be included in compositions of the present invention, at their conventional art-established levels for use (generally, adjunct materials comprise, in total, from about 1% to about 90%, preferably from about 5% to about 75%, more preferably from about 10% to about 50%, by weight of the compositions), include other active ingredients such as bleach catalysts, bleach activators, low-foaming nonionic surfactants, chelants, suds suppressors, dispersant polymers, color speckles, silvercare, anti-tarnish and/or anti-corrosion agents, dyes, fillers, germicides, alkalinity sources, hydrotropes, anti-oxidants, enzyme stabilizing agents, solubilizing agents, carriers, processing aids, pigments, pH control agents, and, for liquid formulations, solvents. These adjuncts are described in detail in U.S. Pat. No. 6,143,707, Trinh et al., incorporated herein by reference. Particularly preferred adjuncts are surfactants and enzyme stabilizers, as described in detail hereinafter.

Low-Foaming Nonionic Surfactant—Surfactants are useful in Automatic Dishwashing to assist cleaning, help defoam food soil foams, especially from proteins, and to help control spotting/filming and are desirably included in the present detergent compositions at levels of from about 0.1% to about 20%, preferably from about 0.5% to about 5%, of the composition. In general, bleach-stable surfactants are preferred. ADD (Automatic Dishwashing Detergent) compositions of the present invention prefereably comprise low foaming nonionic surfactants (LFNIs). LFNi can be present in amounts from 0 to about 10% by weight, preferably from about 0.5% to about 4%. LFNIs are most typically used in ADDs on account of the improved water-sheeting action (especially from glass) which they confer to the ADD product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene (PO/EO/PO) reverse block polymers. The PO/EO/PO polymer-type surfactants are well-known to have foam suppressing or defoaming action, especially in relation to common food soil ingredients such as egg.

In a preferred embodiment, the LFNI is an ethoxylated surfactant derived from the reaction of a monohydroxy alcohol or alkylphenol containing from about 8 to about 20 carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Highly preferred ADDs herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 100%, preferably from about 30% to about 70%, of the total LFNI.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant ADDs. Certain of the block polymer surfactant compounds designated PLURONIC® and TETRONIC® by the BASF-Wyandotte Corp., Wyandotte, Mich., are suitable in ADD compositions of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Suitable for use as LFNI in the ADD compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include a $C_{18}$ alcohol polyethoxylate, having a degree of ethoxylation of about 8, commercially available as SLF18 from Olin Corp., and any biodegradable LFNI having the melting point properties discussed hereinabove.

Enzyme-containing compositions, especially liquid compositions, herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof.

Method for Cleaning

The present invention also encompases a method for cleaning soiled tableware comprising contacting said tableware with an aqueous bath comprising the above automatic dishwashing detergent composition comprising a blooming perfume composition, bleaching agent or detergent enzyme, and builder. The preferred aqueous medium has an initial pH in a wash solution of from about 7 to about 12, more preferably from about 8 to about 11.5, most preferably from about 8.5 to about 11.3.

This invention also encompases a method of washing tableware in a domestic automatic dishwashing appliance, comprising treating the soiled tableware in an automatic dishwasher with an aqueous bath comprising the above ADD composition.

The following nonlimiting examples further illustrate ADD compositions of the present invention. Perfume A and Perfume B are examples of preferred blooming perfume compositions of the invention.

| Perfume Ingredients | Wt. % |
|---|---|
| PERFUME A | |
| Blooming Ingredients | |
| Beta Pinene | 0.09 |
| Citronellol | 2.54 |
| Citronellyl Acetate | 1.04 |
| Decyl Aldehyde | 2.00 |
| Delta Damascone | 0.10 |
| Dihydro Myrcenol | 6.75 |
| Geranyl Nitrile | 9.29 |
| d-Limonene | 22.90 |
| Lorysia | 0.74 |
| Lymolene | 9.73 |
| Methyl Nonyl Acetaldehyde | 2.07 |
| Para Cymene | 0.17 |
| Terpineolene | 11.44 |
| Verdox | 3.38 |
| Delayed Blooming Ingredients | |
| Allyl Amyl Glycolate | 0.14 |
| Alpha Terpineol | 0.38 |
| Anisic Aldehyde | 0.18 |
| Ethyl Butyrate | 0.01 |
| Ethyl-2-methyl Butyrate | 0.26 |
| Ethyl-2-methyl Pentanoate | 0.34 |
| Eucalyptol | 1.36 |
| Flor Acetate | 1.81 |
| Frutene | 1.30 |
| Geraniol | 6.33 |
| Ligustral | 2.16 |
| Linalool | 1.03 |
| Methyl Pamplemousse | 1.48 |
| Octyl Aldehyde | 1.43 |
| Prenyl Acetate | 0.46 |
| Triplal | 0.14 |
| Base Masking Ingredients | |
| Citrathal | 1.18 |
| Habanolide 100% | 0.74 |
| Ionone Beta | 0.37 |
| Iso E Super | 0.74 |
| Neobutenone | 0.03 |
| Other Ingredients | |
| Methyl Dihydro Jasmonate | 5.89 |
| PERFUME B | |
| Blooming Ingredients | |
| Beta Pinene | 0.08 |
| Citronellyl Acetate | 3.97 |
| Decyl Aldehyde | 1.75 |
| Delta Damascone | 0.39 |
| Geranyl Nitrile | 4.12 |
| d-Limonene | 17.70 |
| Lorysia | 1.40 |
| Lymolene | 8.50 |
| Para Cymene | 0.15 |
| Terpineolene | 10.00 |
| Tetra Hydro Linalool | 13.52 |

-continued

| Perfume Ingredients | Wt. % |
|---|---|
| Delayed Blooming Ingredients | |
| Allyl Amyl Glycolate | 0.12 |
| Allyl Caproate | 1.59 |
| Ethyl-2-methyl Butyrate | 5.57 |
| Eucalyptol | 0.63 |
| Flor Acetate | 2.11 |
| Frutene | 2.11 |
| Geraniol | 2.70 |
| Ligustral | 4.05 |
| Linalool | 0.90 |
| Methyl Pamplemousse | 1.31 |
| Octyl Aldehyde | 1.25 |
| Phenyl Ethyl Alcohol | 0.45 |
| Prenyl Acetate | 0.40 |
| Violiff | 0.79 |
| Base Masking Ingredients | |
| Citrathal | 0.38 |
| Clonal | 0.16 |
| Cyclabute | 1.59 |
| Florhydral | 0.08 |
| Nectaryl | 2.39 |
| Neobutenone | 0.16 |
| Other Ingredients | |
| Methyl Dihydro Jasmonate | 9.68 |

Perfumes A and B are added to the following ADD compositions of the invention.

EXAMPLE I

Granular compositions of the present invention are as follows:

| | Weight % | |
|---|---|---|
| Ingredients: | A | B |
| STPP | 28.0 | 24.9 |
| $Na_2CO_3$ | 30.5 | 29.9 |
| Polymer[2] | 2.7 | — |
| Sodium Perborate Monohydrate | 4.34 | 4.34 |
| Catalyst[1] | 0.004 | 0.004 |
| Savinase ™ 6.0 T | 0.3 | — |
| Protease D | 0.36 | 0.29 |
| Duramyl ™ | 0.38 | — |
| Termamyl ™ 6.0 T | 0.19 | 0.19 |
| 2.4 R Silicate ($SiO_2$) | 3.3 | 4.0 |
| Nonionic Surfactant[3] | 1.8 | 1.8 |
| Perfume A | 0.13 | — |
| Perfume B | — | 0.10 |
| Sodium Sulfate | 16.4 | 21.3 |
| Moisture & minors | -Balance- | |

[1]Pentaamineacetatocobalt (III) nitrate; may be replaced by MnTACN.
[2]Polyacrylate or Acusol 480N.
[3]PolyTergent SLF-18 from Olin Corporation.

In the above compositions, the catalyst and enzymes are introduced into the final compositions as 200–2400 micron catalyst/enzyme composite particles which are prepared by spray coating, marumarizing, prilling or flaking/grinding operations. If desired, the protease and amylase enzymes may be separately formed into their respective catalyst/enzyme composite particles, for reasons of stability, and these separate composites added to the compositions.

EXAMPLE II

The following examples further illustrate phosphate built ADD compositions which contain a bleach/enzyme particle, but are not intended to be limiting thereof. All percentages noted are by weight of the finished compositions, other than the perborate (monohydrate) component, which is listed as AvO.

| Ingredients: | Weight % A | Weight % B |
|---|---|---|
| Catalyst[1] | 0.008 | 0.004 |
| Savinase ™ 12 T | — | 1.1[2] |
| Protease D | 0.9 | — |
| Duramyl ™ | 1.5 | 0.75 |
| Sodium Tripolyphosphate (STPP) | 31.0 | 30.0 |
| $Na_2CO_3$ | 20.0 | 30.5 |
| Polymer[3] | 4.0 | — |
| Perborate (AvO) | 2.2 | 0.7 |
| Dibenzoyl Peroxide | 0.2 | 0.15 |
| 2 R Silicate ($SiO_2$) | 8.0 | 3.5 |
| Paraffin | 0.5 | 0.5 |
| Benzotriazole | 0.3 | 0.15 |
| PLURAFAC ™ | 2.0 | 0.75 |
| Perfume B | 0.10 | — |
| Perfume A | — | 0.15 |
| Sodium Sulfate, Moisture | -Balance- | |

[1]Pentaammineacetatocobalt (III) nitrate; may be replaced by MnTACN.
[2]May be replaced by 0.45 Protease D.
[3]Polyacrylate or Acusol 480N or polyacrylate/polymethacrylate copolymers.

In Compositions A and B, the catalyst and enzymes are introduced into the compositions as 200–2400 micron composite particles which are prepared by spray coating, fluidized bed granulation, marumarizing, prilling or flaking/grinding operations. If desired, the protease and amylase enzymes may be separately formed into their respective catalyst/enzyme composite particles, for reasons of stability, and these separate composites added to the compositions.

Other dishwashing detergents of the invention are disclosed in Examples III–V.

EXAMPLE III

| Ingredients: | Weight % A | Weight % B |
|---|---|---|
| Savinase ™ 12 T | 2.2 | — |
| Protease D | — | 0.45 |
| Citrate | 34.5 | 30.0 |
| $Na_2CO_3$ | 20.0 | 30.5 |
| Acusol 480 N | 4.0 | — |
| Perborate(AvO) | 2.2 | 0.7 |
| Dibenzoyl Peroxide | 0.2 | 0.15 |
| 2 R Silicate($SiO_2$) | 8.0 | 3.5 |
| Paraffin | — | 0.5 |
| Benzotriazole | — | 0.15 |
| Plurafac ™ | — | 0.75 |
| Perfume A | 0.1 | — |
| Perfume B | — | 0.15 |
| Sodium Sulphate, Moisture | -to balance- | |

EXAMPLE IV

| Ingredients: | Weight % A | Weight % B | Weight % C | Weight % D |
|---|---|---|---|---|
| STPP | 20.0 | 31.0 | 31.0 | 31.0 |
| $Na_2CO_3$ | 20.0 | 20.0 | 20.0 | 20.0 |
| Polymer[3] | 4.0 | 4.0 | 4.0 | 4.0 |
| Perborate (AvO) | 2.2 | 2.2 | 2.2 | 2.2 |
| Catalyst[1] | 0.008 | 0.018 | 0.018 | 0.018 |
| Savinase ™ 6.0 T[2] | 2.0 | 2.0 | 2.0 | 2.0 |
| Termamyl ™ 6.0 T | 1.0 | 1.0 | 1.0 | 1.0 |
| TAED | 2.0 | — | — | — |
| 2 R Silicate ($SiO_2$) | 8.0 | 8.0 | 8.0 | 8.0 |
| Metasilicate | — | — | 2.5 | 2.5 |
| Nonionic Surfactant[4] | 2.0 | 2.0 | 2.0 | 2.0 |
| Perfume A | 0.10 | — | — | 13 |
| Perfume B | — | 0.15 | — | — |
| β-Cyclodextrin/Perfume A complex powder | — | — | 0.30 | — |
| Matrix microcapsules with Perfume B | — | — | — | 0.25 |
| Sodium Sulfate, Moisture | -Balance- | | | |

[1]Pentaamineacetatocobalt (III) nitrate; may be replaced by MnTACN.
[2]May be replaced by 0.45 Protease D.
[3]Polyacrylate or Acusol 480N.
[4]PolyTergent SLF-18 from Olin Corporation.

EXAMPLE V

| Ingredients: | Weight % A | Weight % B |
|---|---|---|
| Sodium tripolyphosphate | 33.17 | 33.02 |
| Sodium carbonate | 29.00 | 29.00 |
| Sodium sulfate | 12.04 | 12.04 |
| Sodium dichlorocyanurate dihydrate (av. $Cl_2$ = 0.28–2.8%) | 2.50 | 2.50 |
| Silicate solids (ratio = 1.6–3.2) | 8.50 | 8.50 |
| Nonionic surfactant* | 2.60 | 2.60 |
| Perfume A | 0.15 | — |
| Perfume B | — | 0.30 |
| dye, and water | To 100% | To 100% |

*Blend of ethoxylated monohydroxy alcohol and polyoxyethylene/polyoxypropylene block polymer.

EXAMPLE VI

Liquid/gel automatic dishwashing detergent compositions of the present invention are as follows:

| Ingredients: | Weight % A | Weight % B | Weight % C |
|---|---|---|---|
| STPP | 22.0 | 16.8 | — |
| Sodium citrate | — | — | 21.9 |
| NaOH | — | 1.9 | 9.5 |
| KOH | 4.7 | 3.6 | 4.6 |
| $H_2SO_4$ | 3.9 | — | — |
| Sodium Hypochlorite | — | 1.15 | — |
| Protease D | 0.60 | — | 0.53 |
| Duramyl | 0.27 | — | 0.31 |
| 1,2 Propanediol | 0.50 | — | — |
| Boric Acid | 3.0 | — | 4.0 |

-continued

| Ingredients: | Weight % A | B | C |
|---|---|---|---|
| $CaCl_2$ | 0.22 | — | 0.014 |
| 3.2 R Silicate ($SiO_2$) | — | 5.4 | — |
| Sodium Benzoate solution | 0.20 | 0.75 | — |
| 1,2 Dihydroxy-propane | — | — | 6.0 |
| Monoethanolamine | — | — | 1.0 |
| Polyacrylate thickener [1] | 1.18 | 1.01 | 1.8 |
| Nonioinic Surfactant [2] | 1.0 | — | 4.0 |
| Perfume A | 0.10 | — | — |
| Perfume B | — | 0.10 | 0.16 |
| Water and minors | | -Balance- | |

[1] Polygel DKP

[2] PolyTergent SLF-18 from Olin Corporation, or Pluronic 25R2

Any of the foregoing ADD compositions can be used in the conventional manner in an automatic dishwashing machine to cleanse dishware, glassware, cooking/eating utensils, and the like.

What is claimed is:

1. An automatic dishwashing detergent composition in the form of a liquid or gel comprising, by weight:

(a) from about 0.0 1% to about 5% of a blooming perfume composition comprising (i) from about 50% to about 99% of blooming perfume ingredients having a boiling point of less than about 260° C. and a ClogP of at least about 3, said perfume composition comprising at least 5 different blooming perfume ingredients, and (ii) from about 0.5% to about 10% of base masking perfume ingredients having a boiling point of more than about 260° C. and a ClogP of at least about 3;

(b) an effective amount of a bleaching agent or detergent enzyme;

(c) from about 10% to about 75% of a detergent builder; and (d) automatic dishwashing detergent adjunct material selected from the group consisting of detergent surfactant, bleach adjunct material, pH-adjusting material, chelating agent, dispersant polymer, material care agent, suds suppressor, and mixtures thereof.

2. The composition of claim 1 wherein said blooming perfume composition also includes delayed blooming perfume ingredients having a boiling point of less than about 260° C. and a ClogP of less than about 3, wherein the weight ratio of blooming perfume ingredients to delayed blooming ingredients is at least about 1.1:1.

3. The composition of claim 2 comprising delayed blooming perfume ingredients selected from the group consisting of: Allyl Amyl Glycolate, Allyl caproate, Amyl acetate (n-Pentyl acetate), Amyl Propionate, p-Anisaldehyde, Anisic Aldehyde, Anisole, Benzaldehyde (Benzenecarboxaldehyde), Benzyl acetate, Benzylacetone, Benzyl alcohol, Benzyl formate, Benzyl propionate, beta-gamma-Hexenol (2-Hexen-l-ol), (+)-Camphor, (+)-Carvone, L-Carvone, Cinnamic alcohol, Cinnamyl formate, cis-Jasmone, cis-3-Hexenylacetate, Citral (Neral), Cumic alcohol, Cuminaldehyde, Cyclal (2,4-Dimethyl-3-cyclohexene-1-carboxaldehyde), Dimethyl benzyl carbinol, Dimethyl benzyl carbinyl acetate, Ethyl acetate, Ethyl acetoacetate, Ethyl amyl ketone, Ethyl benzoate, Ethyl butanoate, Ethyl Butyrate, Ethyl-2-methyl butryrate, Ethyl-2-methyl pentanoate, 3-Nonanone (Ethyl hexyl ketone), Ethyl phenyl acetate, Eucalyptol, Eugenol, Fenchyl alcohol, Flor Acetate (Tricyclodecenylacetate), Frutene (Tricyclodecenyl propionate), gamma Nonalactone, trans-Geraniol, cis-3-Hexen-1-ol/Leaf Alcohol, Hexyl acetate, Hexyl fonnate, Hydratopic alcohol, Hydroxycitronellal, Indole (2,3-Benzopyrrole), Isoamyl alcohol, Isopropyl phenylacetate, Isopulegol, Isoquinoline (Benzopyridine), Ligustral (2,4-Dimethyl-3-Cyclohexene-1-carboxaldehyde), Linalool, Linalool oxide, Menthone, 4-Methylacetophenone, Methyl pentyl ketone, Methyl anthranilate, Methyl benzoate, Methyl Phenyl Carbinyl Acetate (alpha-Methylbenzyl acetate), Methyl Eugenol (Eugenyl methyl ether), Methyl Heptenone (6-Methyl-5-hepten-2-one), Methyl Heptine Carbonate (Methyl 2-octynoate), Methyl Heptyl ketone, Methyl Hexyl ketone, Methyl pamplemousse (1,1-dimethoxy-2,2,5-trimethyl-4-hexene), Methyl salicylate, Dimethyl anthranilate, Nerol, delta-Nonalactone, gamma-Octalactone, 2-Octanol, Octyl Aldehyde (Caprylic aldehyde), p-Cresol, p-Cresyl methyl ether, Acetanisole, 2-Phenoxyethanol, Phenylacetaldehyde, 2-Phenylethyl acetate, Phenethyl alcohol, Phenyl Ethyl dimethyl Carbinol (Benzyl-tert-butanol), Prenyl acetate, Propyl butanoate, (+)-Pulegone, Rose oxide, Safrole, 4-Terpinenol, Aipha-Terpineol, Triplal (2,4-Dimethyl-3-Cyclohexene-1-carboxaldehyde), Veratrole (1,2-Dimethoxybenzene), Violiff and Veridine (Phenylacetaldehyde dimethyl acetal), and mixtures thereof.

4. The composition of claim 2 wherein said blooming perfume composition comprises at least about 60% of blooming perfume ingredients.

5. The composition of claim 1 wherein said blooming perfume composition comprises from about 2% to about 7% of the base masking perfume ingredients having a boiling point of more than about 260° C. and a ClogP of at least about 3.

6. The composition of claim 1 comprising blooming perfume ingredients selected from the group consisting of: Allo-Ocimene, allyl cyclohexanepropionate, Allyl heptanoate, trans-Anethole, Benzyl butyrate, Camphene, Cadinene, Carvacrol, cis-3-Hexenyl tiglate, Citronellol, Citronellyl acetate, Citronellyl nitrile, Citronellyl propionate, Cyclohexyl-ethyl acetate, Decyl Aldehyde (Capraldehyde), Delta Damascone, Dihydromyrcenol, Dihydromyrcenyl acetate, 3,7-Dimethyl-1-octanol, Diphenyloxide, Fenchyl acetate (1,3,3 -Trimethyl-2-norbornanyl acetate), Geranyl acetate, Geranyl formate, Geranyl nitrile, cis-3-Hexenyl isobutyrate, Hexyl Neopentanoate, Hexyl tiglate, alpha-Ionone, Isobomyl acetate, Isobutyl benzoate, Isononyl acetate, Isononyl alcohol (3,5,5-Trimethyl-1-hexanol), Isopulegyl acetate Lauraldehyde, d-Limonene, Linalyl acetate, Lorysia, Lymolene, (−)-L-Menthyl acetate, Methyl Chavicol (Estragole), Methyl n-Nonyl acetaldehyde, Methyl octyl acetaldehycle, beta-Myrcene, Neryl acetate, Nonyl acetate, Nonaylaldehyde, Para-Cymene, alpha-Pinene, beta-Pinene, alpha-Terpinene, gamma-Terpinene, Terpineolene, alpha-Terpinyl acetate, Tetrahydrolinalool, Tetrahydromyrcenol, 2-Undecenal, Verdox (o-t-Butylcyclohexyl acetate), and Vertenex (4-tert.Butylcyclohexyl acetate), and mixtures thereof.

7. The composition of claim 6 comprising base masking perfume ingredients selected from the group consisting of (Ambrettolide) Oxacycloheptadec-10-en-2-one, (Amyl benzoate) n-Pentyl benzoate, Isoamyl cinnamate, alpha-Amylcinnamaldehyde, alpha-Amylcinnamaldehyde dimethyl acetal, (iso-Amyl Salicylate) isopentyl salicylate, (Aurantiol) Methyl anthranilate/hydroxycitronellal Schiff base, Benzophenone, Benzyl salicylate, beta-Caryophyllene, Cedrol, Cedryl acetate, Cinnamyl cinnamate, Citrathal, Citronellyl isobutyrate, Clonal, Cyclohexyl salicyate, Cyclamen aldehyde, Cyclabute, delta-Dodecalactone, (Dihydro Isojasmonate) Methyl 2-hexyl-3-oxo-cyclopentanecarboxylate, Diphenylmethane, Ethylene brassylate, Ethyl undecylenate, Florhydral, iso E Super, (Exaltolide) Pentadecanolide, (Galaxolide) 4,6,6,7,8,8-Hexamethyl-1,3,4,6,7,8-hexahydro-cyclopenta(G)-2-benzopyran, gamma-Methyl Ionone (alpha-Isomethylionone), Geranyl isobutyrate, Habanolide, Hexadecanolide, cis-3-Hexenyl salicylate, alpha-Hexylcinnamaldehyde, n-Hexyl salicylate, Hexadecanolide, Ionone Beta, alpha—Irone, 6-Isobutylquinoline, Lilial (p-tert.Butyl-alpha-methyldihydrocinnamic aldehyde, PT Bucinol), Linalyl benzoate, (2-Methoxy Naphthalene) beta-Naphthyl methyl ether, Nectaryl, Neobutenone, 10-Oxahexadecanolide, Patchouli alcohol, (Phantolide) 5-Acetyl-1,1,2,3,3,6-hexamethylindan, Phenethyl benzoate, Phenethyl phenylacetate, Phenyl Hexanol (3-Methyl-5-phenyl-1-pentanol), Tonalid (7-Acetyl-1,1,3,4,4,6-hexamethyltetralin), delta-Undecalactone, gamma-Undecalactone, and Vertinert Acetate, and mixtures thereof.

8. The composition of claim 7 comprising from about 2% to about 7% of the base masking perfume ingredients.

9. The Composition of claim 7 comprising base masking perfume ingredients selected from the group consisting of Citrathal, Habanolide 100%, Ionone Beta, iso E Super, Neobutenone, Clonal, Cyclabute, Florhydral, and Nectaryl, and mixtures thereof.

10. The composition of claim 9 comprising blooming perfume ingredients selected from the group consisting of Beta Pinene, Citronellol, Citronellyl Acetate, Decyl Aldehyde, Delta Damascone, Dihydro Myrcenol, Geranyl Nitrile, d-Limonene, Lorysia, Lymolene, Methyl Nonyl Acetaldehyde, Para Cymene, Terpineolene, Verdox, and Tetra Hydro Linalool, and mixtures thereof.

11. The composition according to claim 1 wherein the bleaching agent comprises chlorine bleach or a source of hydrogen peroxide.

12. The composition according to claim 1 wherein the detergent builder comprises phosphate builder.

13. The composition according to claim 1 wherein the enzyme is selected from the group consisting of proteases, amylases, and mixtures thereof.

14. The composition of claim 13 wherein the bleaching agent comprises peroxygen bleach and the detergent builder comprises phosphate builder.

15. The composition of claim 14 wherein said blooming perfume composition also includes delayed blooming perfume ingredients having a boiling point of less than about 260° C. and a ClogP of less than about 3, wherein the weight ratio of blooming perfume ingredients to delayed blooming ingredients is at least about 1.1:1.

16. The composition of claim 15 comprising from about 40% to about 75% of water.

17. A method of washing tableware in a domestic automatic dishwashing appliance, said method comprising treating soiled tableware in an automatic dishwasher with an aqueous bath comprising an automatic dishwashing composition according to claim 1.

18. An automatic dishwashing detergent composition in the form of a liquid or gel comprising, by weight:

(a) from about 0.01% to about 5% of a blooming perfume composition comprising (i) from about 50% to about 99% of blooming perfume ingredients having a boiling point of less than about 260° C. and a ClogP of at least about 3 and comprising: Allo-Ocimene, allyl cyclohexanepropionate, Allyl heptanoate, trans-Anethole, Benzyl butyrate, Camphene, Cadinene, Carvacrol, cis-3-Hexenyl tiglate, Citronellol, Citronellyl acetate, Citronellyl nitrile, Citronellyl propionate, Cyclohexyl-ethyl acetate, Decyl Aldehyde (Capraldehyde), Delta Damascone, Dihydromyrcenol, Dihydromyrcenyl acetate, 3,7-Dimethyl-1-octanol, Diphenyloxide, Fenchyl acetate (1,3,3-Trimethyl-2-norbomanyl acetate), Geranyl acetate, Geranyl formate, Geranyl nitrile, cis-3-Hexenyl isobutyrate, Hexyl Neopentanoate, Hexyl tiglate, alpha-Ionone, Isobornyl acetate, Isobutyl benzoate, Isononyl acetate, Isononyl alcohol (3,5,5-Trimethyl-1-hexanol), Isopulegyl acetate Lauraldehyde, d-Limonene, Linalyl acetate, Lorysia, Lymolene, (−)-L-Menthyl acetate, Methyl Chavicol (Estragole), Methyl n-Nonyl acetaldehyde, Methyl octyl acetaldehycle, beta-Myrcene, Neryl acetate, Nonyl acetate, Nonaylaldehyde, Para-Cymene, alpha-Pinene, beta-Pinene, alpha-Terpinene, gamma-Terpinene, Terpineolene, alpha-Terpinyl acetate, Tetrahydrolinalool, Tetrahydromyrcenol, 2-Undecenal, Verdox (o-t-Butylcyclohexyl acetate), Vertenex (4-tert.Butylcyclohexyl acetate), or mixtures thereof, said perfume composition comprising at least 5 different blooming perfume ingredients, and (ii) from about 0.5% to about 10% of base masking perfume ingredients having a boiling point of more than about 260° C. and a ClogP of at least about 3 and comprising Citrathal, Habanolide 100%, Ionone Beta, Neobutenone, Clonal, Cyclabute, Florhydral, Nectaryl, or mixtures thereof;

(b) an effective amount of a bleaching agent or detergent enzyme;

(c) from about 10% to about 75% of a detergent builder; and (d) automatic dishwashing detergent adjunct material selected from the group consisting of detergent surfactant, bleach adjunct material, pH-adjusting material, chelating agent, dispersant polymer, material care agent, suds suppressor, and mixtures thereof.

19. The composition of claim 18, further comprising from about 40% to about 75% of water.

* * * * *